US011859340B2

(12) United States Patent
Park et al.

(10) Patent No.: US 11,859,340 B2
(45) Date of Patent: Jan. 2, 2024

(54) APPARATUS FOR TREATING LAUNDRY

(71) Applicant: LG Electronics Inc., Seoul (KR)

(72) Inventors: Junghyun Park, Seoul (KR); Unkeol Yeo, Seoul (KR); Hyeyong Park, Seoul (KR)

(73) Assignee: LG Electronics Inc., Seoul (KR)

( * ) Notice: Subject to any disclaimer, the term of this patent is extended or adjusted under 35 U.S.C. 154(b) by 129 days.

(21) Appl. No.: 17/399,651

(22) Filed: Aug. 11, 2021

(65) Prior Publication Data

US 2022/0049409 A1 Feb. 17, 2022

(30) Foreign Application Priority Data

Aug. 14, 2020 (KR) ..... 10-2020-0102607

(51) Int. Cl.

| | |
|---|---|
| ***D06F 39/08*** | (2006.01) |
| ***D06F 39/02*** | (2006.01) |
| ***D06F 37/12*** | (2006.01) |
| ***D06F 23/04*** | (2006.01) |

(52) U.S. Cl.

CPC ..... *D06F 39/088* (2013.01); *D06F 23/04* (2013.01); *D06F 37/12* (2013.01); *D06F 39/028* (2013.01)

(58) Field of Classification Search

None

See application file for complete search history.

(56) References Cited

U.S. PATENT DOCUMENTS

| | | | | |
|---|---|---|---|---|
| 5,167,722 | A | 12/1992 | Pastryk et al. | |
| 6,185,774 | B1 | 2/2001 | Tubman | |
| 9,803,304 | B2 * | 10/2017 | Obregon | D06F 17/06 |
| 2012/0240638 | A1 | 9/2012 | Hettinger et al. | |
| 2015/0007396 | A1 * | 1/2015 | Lee | D06F 39/088 68/131 |
| 2015/0114046 | A1 | 4/2015 | Jeong et al. | |
| 2016/0115635 | A1 * | 4/2016 | Lee | D06F 39/083 68/132 |

FOREIGN PATENT DOCUMENTS

| | | |
|---|---|---|
| JP | 2002282587 | 10/2002 |

OTHER PUBLICATIONS

International Search Report and Written Opinion in International Appln. No. PCT/KR2020/000655, dated Nov. 10, 2021, 10 pages.

* cited by examiner

*Primary Examiner* — Cristi J Tate-Sims

(74) *Attorney, Agent, or Firm* — Fish & Richardson P.C.

(57) ABSTRACT

A laundry treating apparatus includes a cabinet, a tub, a water supply part, a drum rotatably located in the tub and including a drum floor surface located on an opposite side of a drum opening, a rotator rotatably located on the drum floor surface within the drum, the rotator including a bottom portion located on the drum floor surface, a pillar protruding from the bottom portion toward the drum opening, and a blade provided to an outer circumferential surface of the pillar, and a spray device connected to the water supply part to spray water supplied from the water supply part into the drum through the drum opening by avoiding the pillar and the blade.

19 Claims, 7 Drawing Sheets

APPARATUS FOR TREATING LAUNDRY

CROSS-REFERENCE TO RELATED APPLICATIONS

Pursuant to 35 U.S.C. § 119(a), this application claims the benefit of earlier filing date and right of priority to Korean Application No. 10-2020-0102607, filed on Aug. 14, 2020, the contents of which are hereby incorporated by reference herein in their entirety.

TECHNICAL FIELD

The present disclosure relates to an apparatus for treating laundry having a rotator provided within a drum.

BACKGROUND

A laundry treatment device is a device that removes contamination from laundry by inserting clothing, bedding, etc. (hereinafter referred to as laundry) inside a drum. The laundry treatment device can perform courses such as washing, rinsing, dehydration, drying, etc., and may be classified into a top loading type or a front loading type based on a way of putting laundry into a drum.

A laundry treatment device may consist of a housing forming an exterior, a tub received in the housing, a drum rotatably located in the tub to receive laundry therein, a water supply part supplying water to the tub, and a detergent supplier supplying a detergent into the drum.

If a drum is rotated by a motor while water is supplied to laundry received in the drum, dirt or stain can be removed from the laundry by friction with the drum and the water.

However, in a washer of a top-loading type, since a water supply part and a detergent supplier are disposed on one side of a top of a cabinet, detergent and water are supplied to one side of a bottom of a drum. Thus, laundry fails to be soaked evenly and appropriately, thereby causing a problem that washing and rinsing performances are degraded. In addition, a rinsing course if performed using a water current by rotation only, thereby causing a problem that it is unable to wash out the detergent efficiently.

Meanwhile, Korean Patent Laid-Open Gazette No. 10-2010-0006142 discloses a washing machine including a spray nozzle that sprays water into a drum to provide an effect of soaking laundry more evenly. The spray nozzle of the prior art can effectively supply water to laundry stored inside the drum by supplying water through a route other than a detergent supplier. In addition, the prior art discloses a spray nozzle that sprays water through a single outlet.

SUMMARY

Accordingly, embodiments of the present disclosure are directed to an apparatus for treating laundry that substantially obviates one or more problems due to limitations and disadvantages of the related art.

One technical task of the present invention is to provide a laundry treatment apparatus including a rotator generating a water current to enhance washing performance.

Another technical task of the present invention is to provide a laundry treatment apparatus including a spray device that sprays water into a drum to enhance washing and rinsing performances.

Another technical task of the present invention is to provide a laundry treatment apparatus including a spray device that sprays water into a drum by avoiding a rotator provided within the drum.

Another technical task of the present invention is to provide a laundry treatment apparatus including a spray device that prevents water from being scattered by a rotator.

In a laundry treatment apparatus having a rotator, a spray device that sprays water in multiple directions is applicable to minimize the scattering of water, which is sprayed by the spray device, due to the rotator and enhance rinsing performance.

It is able to set a spray angle of spraying water from a plurality of nozzles so as to have a similar spray trajectory as a conventional spray device that sprays water in a single direction.

Technical tasks obtainable from the present disclosure are non-limited by the above-mentioned technical tasks. And, other unmentioned technical tasks can be clearly understood from the following description by those having ordinary skill in the technical field to which the present disclosure pertains.

Additional advantages, objects, and features of the disclosure will be set forth in the disclosure herein as well as the accompanying drawings. Such aspects may also be appreciated by those skilled in the art based on the disclosure herein.

To achieve these objects and other advantages and in accordance with the purpose of the disclosure, as embodied and broadly described herein, an apparatus for treating laundry according to one embodiment of the present disclosure may include a cabinet forming an exterior and including a laundry opening for inserting or taking out the laundry, a tub provided within the cabinet to store water therein and including a tub opening communicating with the laundry opening, a water supply part connected to a water supply source to supply water to the tub, a drum rotatably located in the tub and including a drum opening communicating with the tub opening and a drum floor surface located on an opposite side of the drum opening, a rotator rotatably located on the drum floor surface within the drum, the rotator including a bottom portion located on the drum floor surface, a pillar protruding from the bottom portion toward the drum opening, and a blade provided to an outer circumferential surface of the pillar; and a spray device connected to the water supply part to spray water supplied from the water supply part into the drum through the drum opening by avoiding the pillar and the blade.

The spray device may be provided to an outside of the tub.

The cabinet may include a cabinet top side forming a top side and having the laundry opening formed therein and the sprays device may be installed on the cabinet top side.

The cabinet top side may include a laundry opening face forming an inner circumferential surface of the laundry opening and the spray device may be installed on the laundry opening face.

The spray device may include a nozzle supply pipe connected to the water supply part to be supplied with the water from the water supply part and a nozzle part coupled to the nozzle supply pipe to spray the water supplied through the nozzle supply pipe into the drum.

The nozzle part may include a first nozzle and a second nozzle configured to spray the water supplied through the nozzle supply pipe in different directions, respectively.

The first and the second nozzles may spray the water supplied through the nozzle supply pipe in the different directions with reference to the pillar, respectively.

A space formed in the drum may be divided into a first drum space and a second drum space by a virtual plane connecting the nozzle part and the pillar together, the first nozzle may spray the water supplied through the nozzle supply pipe toward the first drum space, and the second nozzle may spray the water supplied through the nozzle supply pipe toward the second drum space.

The first nozzle may spray the water supplied through the nozzle supply pipe in a direction facing a circumferential surface of the drum and the second nozzle may spray the water supplied through the nozzle supply pipe in a direction facing the drum floor surface.

The apparatus may further include a first spray orifice formed at an end portion of the first nozzle by perforating to discharge the water and a second spray orifice formed at an end portion of the second nozzle by perforating to discharge the water, and an area of the first spray orifice may be greater than that of the second spray orifice.

A first angle formed by a first spray direction, which is a direction of discharging the water from a center of the first spray orifice, and a reference direction, which is a direction of free fall of the water, may be greater than a second angle that is an angle formed by a second spray direction, which is a direction of discharging the water from a center of the second spray orifice, and the reference direction.

A first spray amount, which is an amount of water sprayed from the first spray orifice for a reference time, may be greater than a second spray amount that is an amount of water sprayed from the second spray orifice for the reference time.

The apparatus may further include a detergent supply device provided to the cabinet top side to store a detergent therein and supply the detergent to the drum or the tub, and the water supply part may be connected to the detergent supply device and the spray device to supply water into the tub through at least one of the detergent supply device or the spray device.

The water supply part may include an external water supply flow path guiding water supplied by being connected to the water supply source to an inside of the cabinet, a water supply valve connected to the external water supply flow path to selectively open/close the external water supply flow path, an internal water supply flow path connecting the water supply valve and the detergent supply device together to guide the supplied water to the detergent supply device, and a spray water supply flow path connecting the water supply valve and the spray device together to guide the supplied water to the spray device.

The cabinet top side may include a laundry opening face forming an inner circumferential surface of the laundry opening, the spray device may include a nozzle supply pipe connected to the water supply part by penetrating the laundry opening face to be supplied with water from the water supply part and a nozzle part coupled to the nozzle supply pipe to spray the water supplied through the nozzle supply pipe into the drum, and the nozzle supply pipe may be connected to the spray water supply flow path.

Accordingly, the present disclosure provides the following effects and/or advantages.

The present disclosure may provide a laundry treatment apparatus including a rotator generating a water current, thereby enhancing washing performance effectively.

The present disclosure may provide a laundry treatment apparatus including a spray device that enhances washing and rinsing performances.

The present disclosure may provide a laundry treatment apparatus including a spray device that enhances washing and rinsing performances by effectively supplying water to laundry received in a drum.

The present disclosure may provide a laundry treatment apparatus including a spray device capable of reducing losses due to water scattering in a manner of spraying water by avoiding a rotator.

The present disclosure may provide a laundry treatment apparatus including a spray device capable of effectively removing a detergent remaining on laundry by spraying water in various directions.

Effects obtainable from the present disclosure may be non-limited by the above-mentioned effects. And, other unmentioned effects can be clearly understood from the following description by those having ordinary skill in the technical field to which the present disclosure pertains.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. The above and other aspects, features, and advantages of the present disclosure will become more apparent upon consideration of the following description of preferred embodiments, taken in conjunction with the accompanying drawing figures. In the drawings.

DETAILED DESCRIPTION

Reference will now be made in detail to the preferred embodiments of the present disclosure, examples of which are illustrated in the accompanying drawings, in order to facilitate implementation of embodiments of the present disclosure by those skilled in the art to which the present disclosure pertains.

Meanwhile, elements or control method of apparatuses which will be described below are only intended to describe the embodiments of the present disclosure and are not intended to restrict the scope of the present disclosure.

Wherever possible, the same reference numbers will be used throughout the drawings to refer to the same or like parts.

In the present specification, duplicate descriptions of the same components are omitted.

It will be understood that when an element is referred to as being "connected with" another element in the present specification, the element can be directly connected with the other element or intervening elements may also be present. In contrast, when an element is referred to as being "directly connected with" another element, there are no intervening elements present.

In addition, the terms used in this specification are used only to describe specific embodiments, not to limit the present disclosure.

In addition, a singular representation may include a plural representation unless it represents a definitely different meaning from the context.

In the present application, terms such as "include" or "has" are used herein and should be understood that they are intended to indicate an existence of several components, functions or steps, disclosed in the specification, and it is also understood that greater or fewer components, functions, or steps may likewise be utilized.

In addition, the terms 'and/or' in the present specification include a combination of multiple entries described herein or any of them. In the present specification, 'A' or 'B' may include 'A', 'B', or 'both A and B'.

Figure 1:
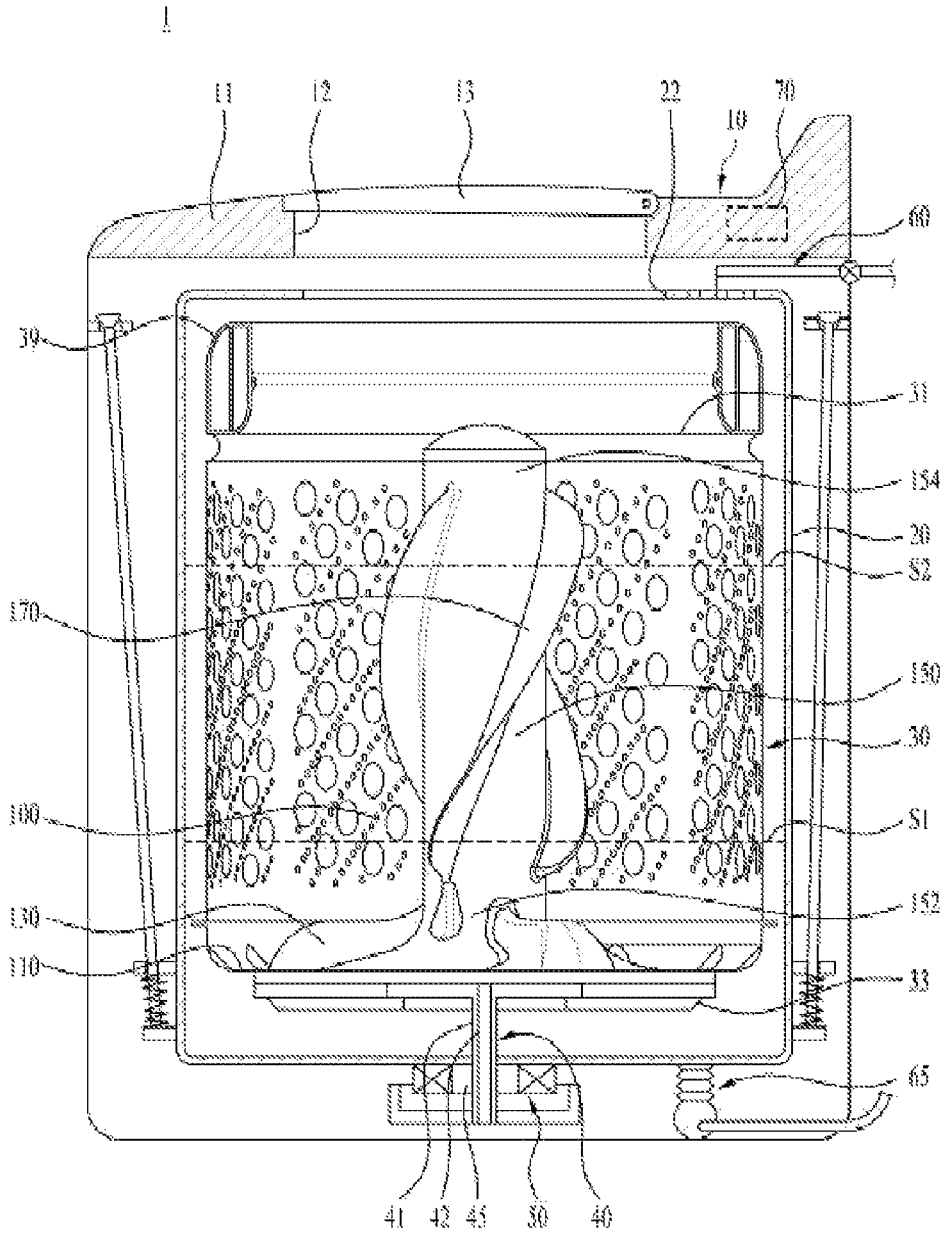
FIG. 1 is a diagram showing an inner structure of a laundry treatment apparatus according to one embodiment of the present disclosure.

FIG. 1 shows an inner structure of a laundry treatment apparatus 1 according to one embodiment of the present disclosure. The laundry treatment apparatus 1 may include a cabinet 10, a tub 20 and a drum 30.

The cabinet 10 may be provided in any configuration that can receive the tub 20 therein, and FIG. 1 shows one example of a case that the cabinet 1 forms an exterior of the laundry treatment apparatus 1.

A laundry opening 12 for supplying laundry to the drum 30 or taking out laundry stored in the drum 30 may be formed in the cabinet 10, and a laundry door 13 may be provided to open/close the laundry opening 12.

Referring to FIG. 1, according to one embodiment of the present disclosure, the laundry opening 12 is formed in a cabinet top side 11 forming a top side of the cabinet 10 and the laundry door 13 to open/close the laundry opening 12 is provided to the cabinet top side 11. Yet, positions of the laundry opening 12 and the laundry door 13 are non-limited to the cabinet top side 11.

The tub 20 is a means for storing water required for washing of laundry, and a tub opening 22 configured to communicate with the laundry opening 12 may be provided to the tub 20. For example, the tub opening 22 may be formed in a manner that one side of the tub 20 is open, and the tub opening 22 may communicate with the laundry opening 12 in a manner that at least one portion of the tub opening 22 is located to confront the laundry opening 12.

FIG. 1 shows the laundry treatment apparatus 1 of the top-loading type according to one embodiment of the present disclosure, thereby showing that the tub opening 22 is formed in a manner of opening the top side of the tub 20 and that the tub opening 22 is located below the laundry opening 12 to communicate with the laundry opening 12.

The tub 20 is fixed to an inside of the cabinet 10 through a tub support part (not shown) that supports the tub 20, and the tub support part may be configured to attenuate the vibration generated from the tub 20.

The tub 20 is supplied with water through a water supply part 60. The water supply part 60 may include a water supply pipe connecting a water supply source and the tub 20 together and a valve opening/closing the water supply pipe.

The laundry treatment apparatus 1 according to one embodiment of the present disclosure may include a detergent supply device configured to store a detergent therein and supply the detergent to the tub 20. The water supply part 60 supplies water to the detergent supply device, whereby the water via the detergent supply device may be supplied to the tub 20 together with the detergent.

The laundry treatment apparatus 1 according to one embodiment of the present disclosure may include a water spray device spraying water into the tub 20 through the tub opening 22. The water supply part 60 may be connected to the water supply device, thereby directly supplying water into the tub 20 through the water spray device.

The water stored in the tub 20 is discharged from the cabinet 10 through a drain part 65, and the drain part 65 may include a drain pipe guiding the water in the tub 30 to an outside of the cabinet and a drain pump provided to the drain pipe.

The drum 30 may be rotatably provided within the tub 20. To be rotatably provided within the tub 20, the drum 30 may be configured to have a circular cross section. For example, as shown in FIG. 1, the drum 30 may be configured in a cylindrical shape.

A drum opening 31 communicating with the entrance may be provided in a manner of being located below the tub opening 22. As described in the following, one side of the drum opening 31 is open, thereby forming an open side. Namely, the open side may correspond to the drum opening 31.

A multitude of perforated holes of the drum 30 may be provided to an outer circumference of the drum 30 so that an inside and an outside of the drum, i.e., the inside of the drum 30 and an inside of the tub 20 partitioned by the drum 30 can communicate with each other. Hence, water supplied to the tub 20 may be supplied into the drum 30, in which laundry is stored, through the perforated holes of the drum 30.

The drum 30 may be rotated by a drive part 50. The drive part 50 may include a stator fixed to an outside of the tub 20 so as to form a rotating magnetic field by being supplied with current, a rotor rotated by the rotating magnetic field, and a rotating shaft 40 provided to perforate the tub 20 to connect the rotor to the drum 30 and the like.

As shown in FIG. 1, the rotating shaft 40 may be configured to form a vertical angle to a bottom side of the tub 20. In this case, the laundry opening 12 may be provided to a cabinet top side 11, the tub opening 22 may be provided to a top side of the tub 20, and the drum opening 31 may be provided to a top side of the drum 30.

Meanwhile, when the drum 30 rotates in a state that laundry is concentrated on a predetermined area within the drum 30, a dynamic balance broken state (i.e., an unbalanced state) occurs in the drum 30. If the drum 30 in the unbalanced state rotates, the drum 30 vibrates and rotates by a centrifugal force applying to the laundry. The vibration of the drum 30 is transferred to the tub 20 or the cabinet 10, whereby a noise-inducing problem may be caused.

To prevent such a problem, the present disclosure may further include a balancer 39 controlling an unbalanced state of the drum 30 by generating a force of cancelling or reducing a centrifugal force working on laundry.

Meanwhile, referring to FIG. 1, the tub 20 may have a space formed inside to store water therein, and the drum 30 may be rotatably provided within the tub 20. The drum 30 may include the drum opening 31 through which laundry is put in or taken out and a drum floor surface 33 located at an opposite side of the drum opening 31.

According to one embodiment of the present disclosure, FIG. 1 shows that a top side of the drum 30 corresponds to the drum opening 31 and a bottom side of the drum 30 corresponds to the drum floor surface 33. As described above, the drum opening 31 may correspond to a side through which laundry inserted through the laundry opening 12 of the cabinet 10 and the tub opening 22 of the tub 20 passes.

Meanwhile, the water supply part 60 may be configured to supply water into the tub 20 in a manner of being connected to such a means as a detergent supply device, a water spray device, etc. in some implementations, one embodiment of the present disclosure may include a controller 70 adjusting a water supply amount by controlling the water supply part 60 in a washing course and the like.

The controller 70 is configured to adjust a water supply amount supplied to the tub 20 in a washing course, a rinsing course and the like, and the water supply amount may be adjusted through a manipulating part provided to the cabinet 10 and manipulated by a user, an amount of laundry, a load of the drive part 50, etc.

When a plurality of water supply amounts are preset, the controller 70 may be configured to control the water supply part 60 according to one of the preset water supply amounts based on a command selected by a user or the like in a washing course and the like.

Meanwhile, as shown in FIG. 1, one embodiment of the present disclosure may further include a rotator 100. The rotator 100 may be installed to be rotatable on the drum floor surface 33 within the drum 30.

According to one embodiment of the present disclosure, each of the rum 30 and the rotator 100 may be configured rotatably. A water current is generated by rotations of the drum 30 and the rotator 100 and collision or friction with laundry occurs, whereby washing or rinsing of the laundry may be performed.

Figure 2:
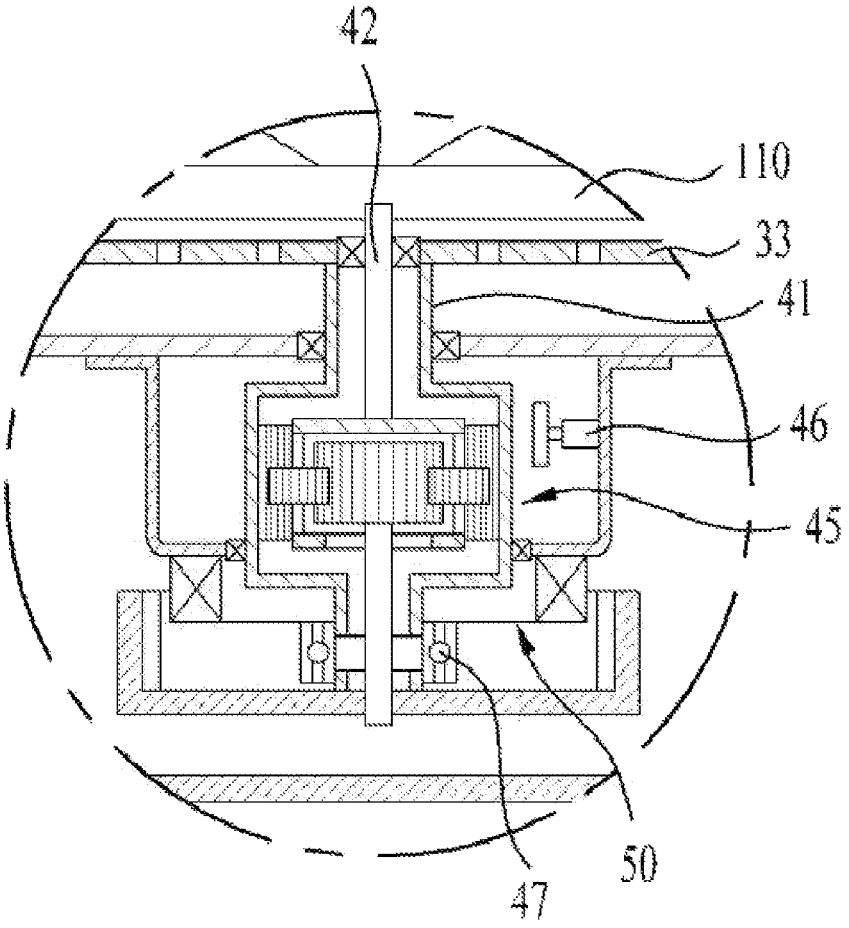
FIG. 2 is a diagram showing a rotation shaft coupled to a drum and a rotator in a laundry treatment apparatus according to one embodiment of the present disclosure.

FIG. 2 shows the rotating shaft 40 coupled to the drum 30 and the rotator 100 according to one embodiment of the present disclosure.

Each of the drum 30 and the rotator 100 may be provided with a turning force by being connected to the drive part 50 via the rotating shaft 40. According to one embodiment of the present disclosure, the drum 30 is rotates in a manner that a first rotating shaft 41 is coupled to the drum floor surface 33 and the rotator 100 may be rotated in a manner of being coupled to a second rotating shaft 42 perforating the drum floor surface 33 and rotated separately from the first rotating shaft 41.

The second rotating shaft 42 may be rotated in the same or opposite direction of the first rotating shaft 41. The first rotating shaft 41 and the second rotating shaft 42 may be configured to receive power through a single drive part 50, and the drive part 50 may be connected to a gear set 45 distributing power to the first rotating shaft 41 and the second rotating shaft 42 and adjusting a rotation direction.

Namely, the drive shaft of the drive part 50 is connected to the gear set 45 to transfer power to the gear set 45, and each of the first rotating shaft 41 and the second rotating shaft 42 may receive the power by being connected to the gear set 45.

The first rotating shaft 41 may include a hollow shaft and the second rotating shaft 42 may include a solid shaft disposed within the first rotating shaft 41. Therefore, according to one embodiment of the present disclosure, power can be effectively provided to the first rotating shaft 41 and the second rotating shaft 42, which are positioned side by side, via the single drive part 50.

In FIG. 2, the gear set 45 of the sun & planet gear type is shown and each of the first rotating shaft 41 and the second rotating shaft 42 is coupled to the gear set 45. The rotation relationship between the first rotating shaft 41 and the second rotating shaft 42 according to one embodiment of the present disclosure is described with reference to FIG. 2 as follows.

The drive shaft of the drive part 50 may be connected to a sun gear at the center in the gear set 45 of the sun & planet gear type. As the drive shaft is rotated, the planet gear and the ring gear of the gear set 5 may be rotated by the rotation of the sun gear.

The first rotating shaft 41 coupled to the drum floor surface 33 may be connected to the ring gear located at the most outer position of the gear set 45. The second rotating shaft 42 coupled to the rotator 100 may be connected to the planet gear disposed between the sun gear and the ring gear in the gear set 45.

In some implementations, the gear set 45 may include a first clutch element 46 and a second clutch element 47 capable of restricting rotation of each rotating shaft 40 in necessary. The gear set 45 may further include a gear housing fixed to the tub 20, and the first clutch element 46 may be configured to selectively restrict the rotation of the first rotating shaft 41 provided to the gear housing and connected to the ring gear.

The second clutch element 47 may be configured to mutually restrict the rotations of the drive shaft and the ring gear or release the restriction. Namely, to rotation of the ring gear or the rotation of the first rotating shaft 41 may be synchronized or desynchronized with the drive shaft by the second clutch member 47.

According to one embodiment of the present disclosure, if the first clutch element 46 and the second clutch element 47 are in a released state, the first rotating shaft 41 and the second rotating shaft 42 rotate in opposite directions depending on the rotation relationship of the planet gear, respectively. Namely, the drum 30 and the rotator 100 rotate in opposite directions, respectively.

Meanwhile, if the first clutch element 46 is in a restricted state, rotations of the ring gear and the first rotating shaft 41 are restricted but rotation of the second rotating shaft 42 is performed. Namely, the drum 30 is in a stopped state but the rotator 100 rotates only. In doing so, a rotation direction of the rotator 100 may be determined depending on the rotation direction of the drive part 50.

Meanwhile, if the second clutch element 47 is in a restricted state, rotations between the drive shaft and the first rotating shaft 41 are restricted mutually and rotations of the first rotating shaft 41 and the second rotating shaft 42 may be restricted mutually depending on the rotation relationship of the planet gear. Namely, the drum 30 and the rotator 100 rotate in the same direction.

If the first clutch element 46 and the second clutch element 47 are simultaneously in a restricted state, the drive shaft, the first rotating shaft 41 and the second rotating shaft 42 are in the stopped state all. The controller 70 appropriately controls the drive part 50, the first clutch element 46, the second clutch element 47 and the like in the washing course, the ringing course and the like, thereby implementing a necessary driving state.

Figure 3:
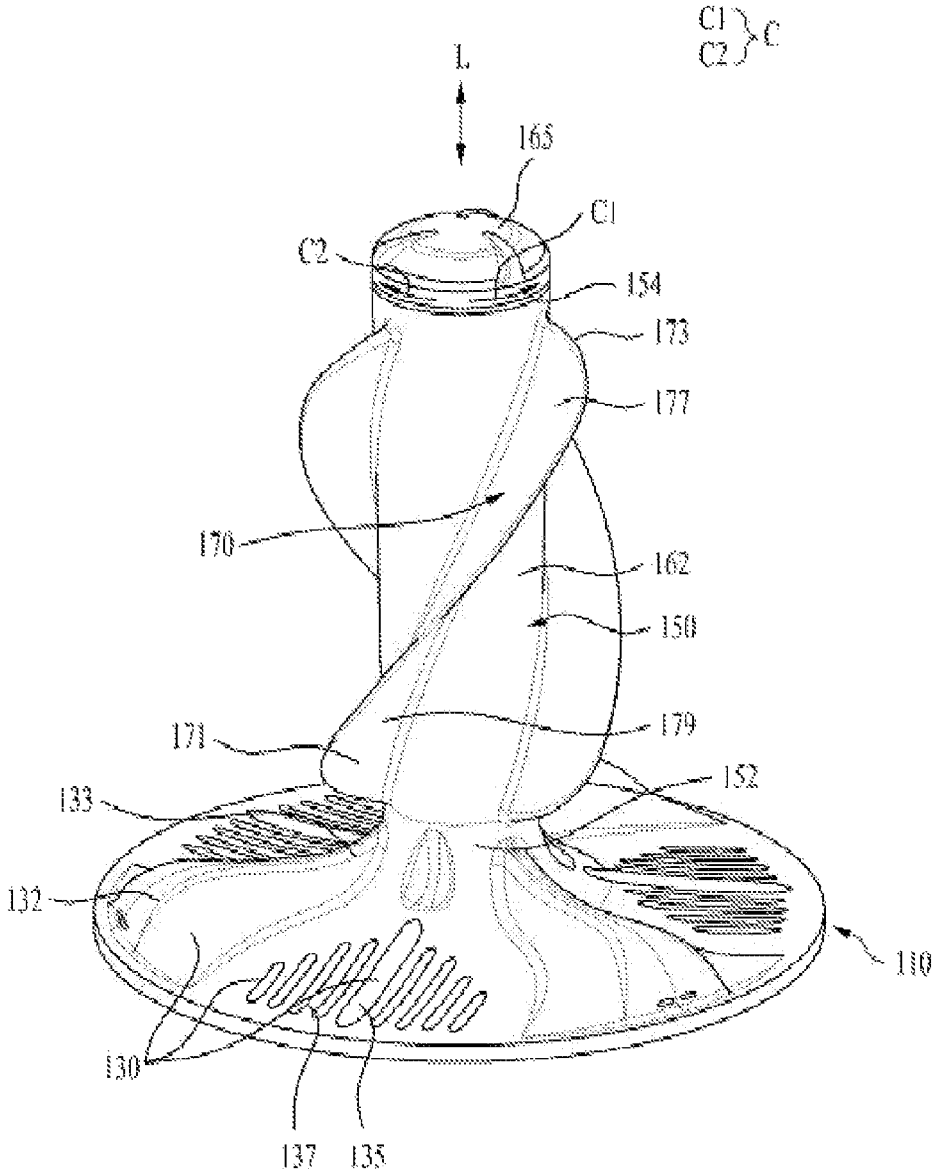
FIG. 3 is a perspective diagram showing a rotator of a laundry treatment apparatus according to one embodiment of the present disclosure.

FIG. 3 is a perspective diagram of the rotator 100 according to one embodiment of the present disclosure. The rotator 100 according to one embodiment of the present disclosure may include a bottom portion 110, a pillar 150 and a blade 170.

The bottom portion 110 may be located on the drum floor surface 33. As the bottom portion 110 is located side by side the drum floor surface 33, it may be configured to be rotatable on the drum floor surface 33. The aforementioned second rotating shaft 42 may be coupled to the bottom portion 110.

Namely, the first rotating shaft 41 may be coupled to the drum 30, and the second rotating shaft 42 provided as a solid shaft within the rotating shaft 41 in a hollow shape may be coupled to the bottom portion 110 of the rotator 100 by perforating the drum floor surface 33.

The rotator 100 coupled to the second rotating shaft 42 may be rotated independently from the drum 30. Namely, the rotator 100 may be rotated in the same or opposite direction of the drum 30 and such a rotation direction may be selected by the controller 70 or the like if necessary.

The first rotating shaft 41 may be coupled to the center of the drum floor surface 33. According to one embodiment of the present disclosure, as shown in FIG. 1, the top side of the drum 30 is open to form the drum opening 31 and the bottom side of the drum 30 corresponds to the drum floor surface 33.

Namely, the laundry treatment apparatus 1 shown in FIG. 1 corresponds to a top loader, the drum 30 may have a lateral side, i.e., an outer circumference connecting the top side and the bottom side to each other, and a cross section of the drum 30 may have a circular shape for the balancing of rotation.

A bottom portion 110 of the rotator 100 may have the second rotating shaft 42 coupled to its center. The second rotating shaft 42 may be coupled to one side of the bottom portion 110 facing the drum 30, i.e., the bottom side of the bottom portion 110, and the second rotating shaft 42 may be coupled to the bottom portion 110 by perforating the center of the drum 30.

The bottom portion 110 may have a circular cross section in consideration of the balancing of rotation. The bottom portion 110 may be rotated centering around the second rotating shaft 42 coupled to the center thereof, and the center of the bottom portion 110 may match the center of the drum 30.

The bottom portion 110 may have a disc shape basically, and, as described below, its specific shape may be determined in consideration of the connection relationship of a projection part 130, a pillar 150 and the like.

The bottom portion 110 may be configured to cover at least one portion of the drum 30. The bottom portion 110 may be configured to facilitate rotation in a manner that a bottom surface and the drum 30 are spaced apart from each other. Yet, a spaced distance between the bottom portion 110 and the drum floor surface 33 may be set variously as necessary.

Meanwhile, as shown in FIG. 3, the pillar 150 may have a shape protruding from the bottom portion 110 toward the drum opening 31. The pillar 150 may be formed with the bottom portion 110 as an integral part or coupled to the bottom portion 110 by being manufactured separately.

The pillar 150 may be rotated with the bottom portion 110. The pillar 150 may be extended from the center of the bottom portion 110 toward the drum opening 31. FIG. 1 shows the pillar 150 projected and extended upward from the bottom portion 110 according to one embodiment of the present disclosure. The pillar 150 may have a cross section in a circular shape, and a projected height L1 from the bottom portion 110 may be set variously.

A lateral side of the pillar 150 may be curved to form an outer circumferential surface 162, the rotator 100 may include a blade 170, and the blade 170 may be provided to the outer circumferential surface 162 of the pillar 150.

The blade 170 may be configured to be projected from the pillar 150 and extended along the pillar 150 so as to generate a water current within the drum on rotation of the pillar 150.

A plurality of the blades 170 may be provided. A plurality of the blades 170 may be disposed in a manner of being spaced apart from each other in a circumferential direction C and extended from a side of the bottom portion 110 toward the drum opening 31 along a direction inclined to a length direction L of the pillar 150.

Particularly, as shown in FIG. 3, the blade 170 may be extended along the length direction L of the pillar 150 approximately. A plurality of the blades 170 may be provided, and the number of the blades 170 may be various as necessary. FIG. 3 shows that three blades 170 are provided to the outer circumferential surface 162 of the pillar 150 according to one embodiment of the present disclosure.

The blades 170 may be equally disposed along the circumferential direction C of the pillar 150. Namely, a spaced length L5 between the blades 170 may be identical. When the blades 170 are viewed from the drum opening 31 of the drum 30, they may be disposed in a manner of being spaced apart from each other by forming an angle of 120 degrees mutually with reference to the center C1 of the pillar 150.

The blade 170 may be extended along a direction inclined to the length direction L or the circumferential direction C of the pillar 150. The blade 170 may be extended in an inclined direction, thereby being extended on the outer circumferential surface 162 of the pillar 150 from the side of the bottom portion 110 toward the drum opening 31. The extended length L3 of the blade 170 may be various as necessary.

As the blade 170 is extended in the inclined direction, if the rotator 100 is rotated, an ascending or descending water current may be formed in the water in the drum 30 by the blade 170 of the pillar 150.

For example, when the blade 170 is inclined from the side of the bottom portion 110 toward one direction C1 in the circumferential direction C of the pillar 150 and extended toward the drum opening 31, if the rotator 100 rotates in the one direction C1, a descending water current may be formed by the inclined shape of the blade 170. If the rotator 100 is rotated in the other direction C2, an ascending water current may be formed by the blade 170.

According to one embodiment of the present disclosure, the one direction C1 and the other direction C2 for the circumferential direction C of the pillar 150 correspond to opposite directions to the outer circumferential surface 162 of the pillar 150 and may include a direction vertical to the length direction L of the pillar 150.

The one direction C1 and the other direction C2 for the circumferential direction C of the pillar 150 may correspond to a rotation direction of the rotator 100. As the rotation direction of the rotator 100 and the circumferential direction C of the pillar 150 are in parallel with each other, the rotator 100 may be rotated in the one direction C1 or the other direction C2.

According to one embodiment of the present disclosure, as a plurality of the blades 170 are provided and disposed in a manner of being spaced from each other, the water current may be formed evenly by the pillar. When the rotator 100 rotates, an ascending water current that water in a lower part of the drum 30 moves to an upper part or a descending water current that water in the upper part of the drum 30 moves to the lower part may be generated by the inclined and extended shape of the blade 70 instead of a water current of a simple rotation type.

According to one embodiment of the present disclosure, a 3-dimensional water current can be formed by the rotting part 100, whereby the washing efficiency on laundry in a washing course can be improved considerably. In addition, washing can be performed in various ways using ascending and descending water currents appropriately.

The blade 170 of the present disclosure may correspond to a screw shape. Namely, a plurality of the blades 170 are provided and disposed along the circumferential direction C of pillar 150 in a manner of being spaced apart from each other and may be extended in a screw shape from one end portion 171 facing the bottom portion 110 to the other end portion 173 facing the drum opening 31.

So to speak, according to one embodiment of the present disclosure, the pillar 150 may be extended from one end portion 152 facing the bottom portion 110 to the other end portion 154 facing the drum opening 31 in a manner that a plurality of the blades 170 are wound on the outer circumferential surface 162.

In some implementations, referring to FIG. 3, according to one embodiment of the present disclosure, the blade 170 may be inclined in one direction C1 of the circumferential direction C of the pillar 150 for the length direction L of the pillar 150 and extended from the one end portion 171 to the other end portion 173.

Namely, the blade 170 may be configured to be inclined in one direction C1 only in a manner that an inclined direction is not changed into the other direction C2. If the inclined direction of the blade 170 is changed into the other direction C2 in the course of extending the blade 170, when the rotting part 100 rotates, one portion of the blade 170 may generate an ascending water current and the rest may generate a descending water current.

In this case, since the ascending water current and the descending water current may be simultaneously generated on rotation in the one direction C1 of the rotator 100, it may be difficult to maximize an ascending or descending effect of water.

Therefore, according to one embodiment of the present disclosure, the blade 170 is extended in a manner of being inclined to the length direction L of the pillar 150, and more particularly, to one direction C1 of the circumferential direction C of the pillar 150, thereby maximizing the water current property for the rotations of the one direction C1 and the other direction C2 of the rotator 100. The one direction C1 may include one of 'clockwise' and 'counterclockwise', and the other direction C2 may include the other.

In some implementations, according to one embodiment of the present disclosure, as shown in FIG. 3, the blade 170 may be continuously extended from the one end portion 171 to the other end portion 173. Namely, the blade 170 may be extended continuously and seamlessly between the one end portion 171 and the other end portion 173.

In addition, the blade 170 may be extended from the one end portion 171 to the other end portion 173 in a manner of being inclined to the length direction L of the pillar 150. Namely, the blade 170 may be configured in a manner of being inclined entirely without a portion side by side with the length direction L of the pillar 150.

In case that at least one portion of the blade 170 is parallel to the length direction L or the circumferential direction C of the pillar 150, it may be disadvantageous for the ascending or descending water current formation according to the rotation of the pillar 150. Therefore, according to one embodiment of the present disclosure, the blade 170 may be configured to be inclined to the length direction L of the pillar 150 in the entire length L2.

Figure 4B:
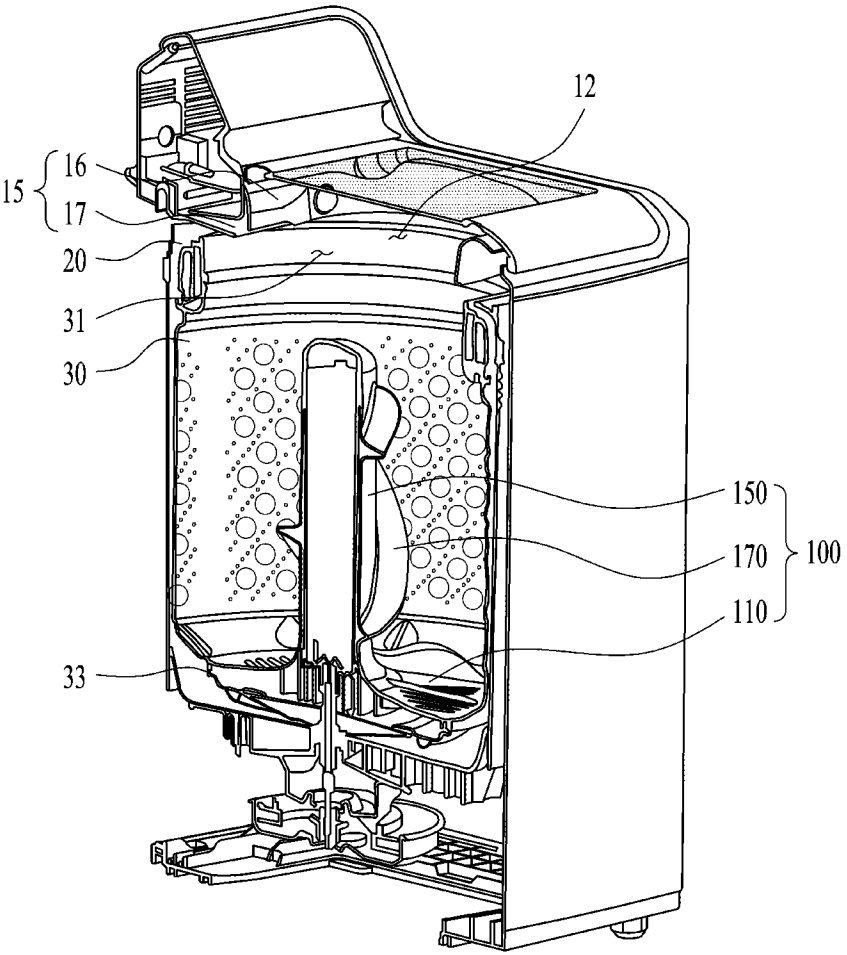
FIGS. 4A and 4B are a perspective diagram and a longitudinal-section perspective diagram of a laundry treatment apparatus including a spray device according to one embodiment of the present disclosure, respectively.
Figure 4A:
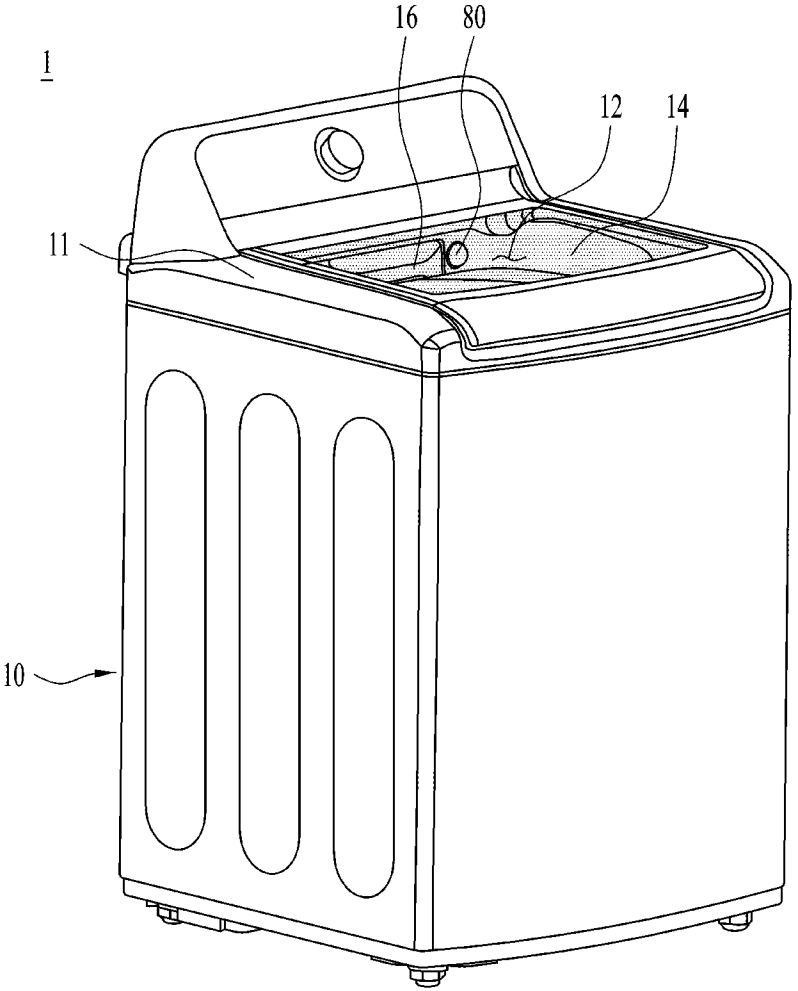

FIGS. 4A and 4B show a laundry treatment apparatus having a spray device according to one embodiment of the present disclosure. FIG. 4A is a perspective diagram of a whole laundry treatment apparatus, and FIG. 4B is a longitudinal cross-sectional perspective diagram.

Referring to FIGS. 4A and 4B, the laundry treatment apparatus 1 may include a cabinet 10 forming an exterior and including a laundry opening 12 for inserting or taking out laundry, a tub 20 provided within the cabinet 10 to store water therein and including a tub opening 22 communicating with the laundry opening 12, a water supply part 60 connected to a water supply source to supply water to the tub 20, a drum 30 rotatably installed in the tub 20 and including a drum opening 31 communicating with the tub opening 22 and a drum floor surface 33 located on an opposite side of the drum opening 31, and a rotator 100 rotatably installed on the drum floor surface 33 within the drum 30.

The rotator 100 includes a bottom portion 110 located on the drum floor surface 33, a pillar 150 projected from the bottom portion 110 toward the drum opening 31, and a blade 170 provided to an outer circumferential surface of the pillar 150. The laundry treatment apparatus 1 further includes a spray device 80 connected to the water supply part 60 to spray water supplied from the water supply part 60 into the drum 30 through the drum opening 31 by avoiding the pillar 150 and the blade 170.

The spray device 80 may spray the water supplied from the water supply source into the drum 30. Generally, the water supplied from the water supply source is supplied into the tub 20 and the drum 30 through a detergent supply device 15. Yet, according to one embodiment of the present disclosure, the water necessary for washing may be supplied through the detergent supply device 15 or the spray device 80.

The spray device 80 may spray water in various directions unlike that water simply falls from the detergent supply device toward the bottom of the drum 30. The water sprayed by the spray device 80 may be sprayed in a pattern of an arc of a fan shape. As described above, in case of supplying water into the drum 30, a sprayed area of water can be increased in comparison to supplying water by simply letting water fall. Thus, by spraying water to a wider area using the spray device 80, the stuff stored in the drum 30 may be soaked more effectively. This may solve the problem that laundry received inside fails to be sufficiently soaked in a washing course.

The spray device 80 sprays water at a high speed as well as soaks laundry in water effectively, thereby bringing an advantageous effect in a rinsing course. If the spray device 80 is not included, a step of generating a water current by applying a rotation force to water stored in the tub 20 and a step of rinsing laundry using the generated water current are performed in a laundry rinsing course. However, in case that foreign substances or detergent particles penetrate the space between the fibers, it may not be possible to remove them sufficiently using only the above water current.

On the contrary, the spray device 80 may spray the water supplied through the water supply part 60 at a high speed in the rinsing course. The water sprayed from the spray device 80 may have a momentum higher than that of the water simply free-falling through the detergent supply device 15. As described above, the laundry stored in the drum 30 may be beaten by the water with the high momentum. Through this, foreign substances or detergent particles remaining on the laundry can be removed effectively.

In case that water is sprayed from the spray device 80 toward an inside of the drum 30, it may beat the pillar 150 and the blade 170 that configure the rotator 100. Thus, if the water sprayed from the spray device 80 fails to reach the laundry stored in the drum 30 but is interrupted by the pillar 150 or the blade 170, it is unable to obtain the effect of improving the rinsing performance. Therefore, the spray device 80 may spray the water supplied through the water supply part 60 into the drum 30 in a manner of avoiding the pillar 150 and the blade 170.

In addition, the water sprayed from the spray device 80 may be sprayed at a speed over a predetermined level. Therefore, in case that the water sprayed from the spray device 80 beats the pillar 150 or the blade 170, it may deform the pillar 150 or the blade 170. If such impact continues, it may result in fatigue breakage of the blade 170. To prevent such a problem from being caused, in the laundry treatment apparatus including the rotator 100 like the present disclosure, the water sprayed from the spray device 80 may be sprayed in directions for avoiding the pillar 150 and the blade 170. When the spray device 80 sprays water into a space within the drum 30 except the pillar 150 and the blade 170, the lifespans of the pillar 150 and the blade 170 can be increased and the washing and rinsing effects can be enhanced.

The spray device 80 sprays the water supplied from the water supply part 60 into the drum 30 through the drum opening 31. Hence, the spray device 80 may be provided to an outside of the tub 20. The spray device 80 is supplied with the sprayed water by being connected to the water supply part 60. Hence, if the spray device 80 is installed in the rotating configuration like the drum 30, it may cause a problem of a physical connection to the water supply part 60. Hence, the spray device 80 is preferably installed in a component that is not moving among the components that configure the laundry treatment apparatus 1.

Generally, the tub 20 stores water necessary for washing and the detergent supply device 15 connected to the water supply part 60 is installed outside the tub 20 to supply water. As the water supply part 60 supplies water by being connected to the detergent supply device 15, the water supply part 60 may be coupled to the outside of the tub 20 as well. The spray device 80 according to the present disclosure supplies water necessary for washing and rinsing. Hence, the spray device 80 needs to be coupled to the water supply part 60 directly or indirectly. Hence, the spray device 80 may be provided to the outside of the tub 20 so as to be stably connected to the water supply part 60.

As described above, if the spray device 80 is installed outside the tub 20, stability of the water supply part 60 and the spray device 80 can be enhanced.

In case that the spray device 80 is provided to the outside of the tub 20, the supply of the necessary water is facilitated by the water supply part 60 and user's accessibility is improved, thereby facilitating the design, manufacturing and assembly.

As described above, if the spray device 80 is installed outside the tub 20, it may mean that the spray device 80 is installed on one side of the cabinet 10 that is the configuration separated from the tub 20. Since the spray device 80 needs to be supplied with water from the water supply part 60 together with the detergent supply device 15, it may be installed near the detergent supply device 15. Alternatively, the spray device 80 may be installed outside the tub 20. The spray device 80 may be installed at various locations outside the tub 20 if such locations allow water to be sprayed into the drum 30 through the drum opening 31.

Meanwhile, the cabinet 10 may include a cabinet top side 11 forming a top side of the cabinet 10. A laundry opening 12 for inserting or taking out laundry may be formed in the cabinet top side 11. The laundry opening 12 may have a circular cross section or a cross section having one portion formed as a circumferential surface and another portion formed as a straight line.

Since the laundry opening 12 physically has a thickness, it may be configured with a face that encloses the laundry opening 12. Namely, the laundry opening 12 may be configured by the face that perforates the cabinet top side 11. If a cross section of the laundry opening 12 is circular, the laundry opening 12 may be configured with an outer circumferential surface in a cylindrical shape. In the following of the specification, a face configuring an inner circumferential surface of the laundry opening 12 will be referred to as a laundry opening face. As described above, if the cross section of the laundry opening 12 has one portion configured with a straight line and another portion configured with a circumferential surface, prescribed surfaces of the laundry opening face 14 corresponding to the laundry opening 12 may be configured with a rectangle and a circumferential surface, respectively.

The detergent supply device may include a detergent supply box 16 storing a detergent therein and a detergent supply housing 17 supporting the detergent supply box 16. The detergent supply housing 17 may be configured in a manner of perforating the laundry opening face 14. The detergent supply device 15 may be configured in a manner of inserting the detergent supply box 16 into the detergent supply housing 17 formed in a manner of perforating the laundry opening face 14.

The spray device 80 may be installed on the laundry opening face 14 together with the detergent supply housing 17 and the detergent supply box 16. The spray device 80 may be inserted in a spray installation part formed by perforating the laundry opening face 14. The spray device 80 is inserted in the spray installation part and coupled to the water supply part 60 inside the laundry opening face 14 so as to be supplied with water from the water supply source and an outside is installed to face the drum 30, thereby spraying the water supplied by the water supply part 60 toward the drum 30. The water discharged from the spray device 80 passes through the tub opening 22 and the drum opening 31 and may be then stored in the drum 30 and the tub 20.

The spray device 80 installed on the laundry opening face 14 sprays water into the drum 30 but may not spray water to the pillar 150 and the blade 170. Generally, since the laundry opening face 14 is disposed closer to a center axis of the drum in a radial direction than the tub opening 22 or the drum opening 31, water needs to be sprayed into the drum 30 by adjusting a spray angle of the spray device 80 so as to avoid the pillar 150 and the blade 170.

Figure 5C:
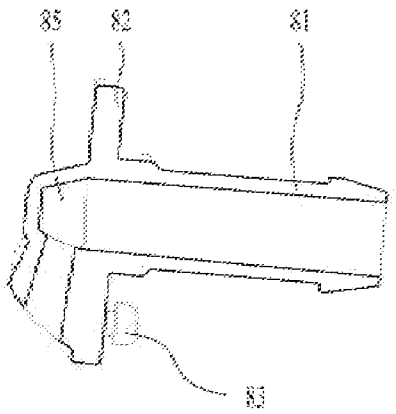
FIGS. 5A to 5C are diagrams of front, bottom and lateral-cross-sectional views of a spray device according to one embodiment of the present disclosure.
Figure 5B:
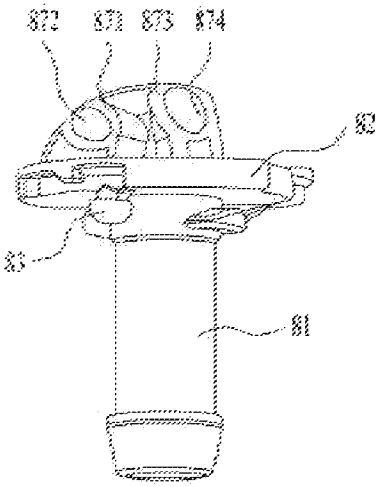
Figure 5A:
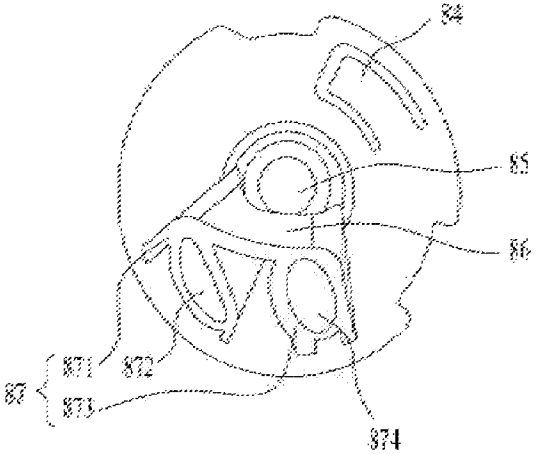

FIGS. 5A to 5C show a spray device according to one embodiment of the present disclosure. FIGS. 5A to 5C are a front view diagram, a bottom view diagram and a lateral cross-sectional diagram of the spray device, respectively.

Referring to FIGS. 5A to 5C, the spray device 80 may include a nozzle supply pipe 81 connected to the water supply part 60 to be supplied with water from the water supply part 60 and a nozzle part 87 coupled to the nozzle supply pipe 81 to spray water supplied through the nozzle supply pipe 81 into the drum 30.

The nozzle supply pipe 81 may be coupled by passing through the laundry opening face 14. The nozzle supply pipe 81 passes through the laundry opening face 14 so that one side of the nozzle supply pipe 81 may be connected to the water supply part 60. The water supplied from the water supply part 60 may be supplied to the spray device 80 through the nozzle supply pipe 81. Alternatively, the nozzle supply pipe 81 does not pass through the laundry opening face 14 but passes but the water supply part 60 passes through the laundry opening face 14 so as to be coupled to the nozzle supply pipe 81. Various structures that the nozzle supply pipe 81 can be supplied with water of the water supply source through the water supply part 60 are applicable.

The water supplied to the nozzle supply pipe 81 may flow to the nozzle part 87 along the nozzle supply pipe 81. A nozzle branch part 85 may be formed at one end portion of the nozzle supply pipe 81 located in a direction of getting away from the water supply part 60. The water passing through the nozzle branch part 85 may flow along the nozzle part 87. By setting the nozzle branch part 85 as a starting point, the nozzle part 87 may include a first nozzle 871 and a second nozzle 873 separating the flow of water in different directions, respectively. From the nozzle branch part 85 as the starting point, a direction of water flowing along the nozzle supply pipe 81 may change rapidly. For example, the water flowing in the nozzle supply pipe 81 in a direction parallel to a ground may flow in a direction vertical to the ground as soon as passes through the nozzle branch part 85. The above case is just exemplary and water may flow in various paths and directions.

As the first nozzle 871 and the second nozzle 873 guide water in different directions, respectively, they may be formed in a manner of being spaced apart from each other. As the first nozzle 871 and the second nozzle 873 may be affected by an external force and vibration due to the fluid flow generated inside, the structural stability may be degraded. To improve such structural stability, a nozzle connecting part 86 connecting the first nozzle 871 and the second nozzle 873 together in front may be formed. The nozzle connecting part 86 may support the first nozzle 871 and the second nozzle 873 externally without affecting inner flow paths and fluid flow of the first nozzle 871 and the second nozzle 873.

A spray mount part 82 may be provided between the nozzle supply pipe 81 and the nozzle branch part 85. The spray mount part 82 may be manufactured in a circular shape having a diameter greater than that of the flow path of the nozzle supply pipe 81. The spray mount part 82 is extended from one end of the nozzle supply pipe 81 in a radial direction, thereby reinforcing the coupling strength with the cabinet top side 11. By increasing a cross-sectional area, a friction surface with the cabinet top side 11 can be increased advantageously.

The spray mount part 82 may increase a friction surface with the cabinet top side 11 and also provide one surface on which the different coupling structure is formed. An elastic projection configured to have an elastic force in front-rear direction of the spray mount part 82 may be provided to one side of the spray mount part 82. The elastic projection 84 may be coupled to a coupling recess formed on the cabinet top side 11. If the elastic projection 84 is fitted into the coupling recess and rotated to a coupling position, the spray mount part 82 may be solidly coupled to the cabinet top side 11 by the elastic force of the elastic projection 84.

A coupling projection 83 may be formed on a backside of the spray mount part 82 in a manner of being projected from the backside toward a rear direction. The coupling projection 83 may be configured to be inserted in a coupling recess formed on the cabinet top side 11. In the coupling projection 83, a portion extended from the backside of the spray mount part 82 is formed to have a small cross-sectional area and a projection portion may be formed to have a large cross-sectional area. In the coupling recess of the cabinet top side 11, in which the coupling projection 83 is inserted, a recess is formed to have the coupling projection 83 inserted therein and a width of the recess may be decreased depending on a rotation direction of the coupling projection 83. Hence, when the coupling projection 83 is initially inserted in the coupling recess, it may be easily inserted or pulled out. Yet, if the coupling projection 83 is inserted in the coupling recess and then rotated along the coupling recess, the coupling projection 83 may not be easily pulled out of the coupling recess due to a cross-sectional area difference between the coupling recess and the coupling projection 83. In this manner, the spray mount part 82 may be coupled to the cabinet top side 11. Namely, the spray device 80 can be coupled to the cabinet top side 11 more solidly.

As described above, the spray device 80 may be solidly coupled to the cabinet top side 11. Alternatively, the spray device 80 may be coupled to various positions capable of spraying water into the drum 30 as well as to the cabinet top side 11. As a method of reinforcing the coupling, the elastic projection 84 or the coupling projection 83 is usable.

Regarding the nozzle part 87, the nozzle part 87 may include the first and second nozzles 871 and 873 spraying water in different directions, respectively. Alternatively, if it is requested to spray water in various directions, a plurality of nozzles may be configured as well as the first nozzle 871 and the second nozzle 873.

A first spray orifice 872 and a second spray orifice 874, through which water is sprayed, may be formed in the first nozzle 871 and the second nozzle 873, respectively. Water having passed through the first spray orifice 872 or the second spray orifice 874 may enter the drum 30 by inertia and gravity.

The water sprayed through the first spray orifice 872 and the second spray orifice 874 may be sprayed in different directions. The water passing through the first spray orifice 872 or the second spray orifice 874 may be affected by various external forces such as gravity and the like as well as a spray force. Hence, the straightness of the sprayed water may be lowered. In addition, if the sprayed water leaves the spray orifice, the radial resistance disappears. Hence, if the water gets far away from the spray orifice, it expands in the radial direction. Therefore, when the sprayed water reaches an object, it may reach an area wider than the spray orifice.

As described above, the first spray orifice 872 or the second spray orifice 874 may have different spray directions, respectively. Here, the spray direction may mean a direction of a speed at which fluid passes through the spray orifice. Namely, if a spray orifice is regarded as a plane, the spray direction may mean an average of vector values of speeds of water particles existing in the corresponding plane.

In addition, if the first spray orifice 872 or the second spray orifice 874 is regarded as a plane, the spray direction may mean a normal direction of the plane. Here, 'normal' means a line vertical to a specific plane.

In the present specification, as described above, the spray direction may mean a direction of a normal extended from a center of gravity of a spray orifice.

As described above, the first nozzle 871 and the second nozzle 873 may spray the water supplied from the water supply part 60 through the nozzle supply pipe 81 in different spray directions, respectively. In addition, beyond simply spraying water in different directions, the water may be sprayed in different directions with reference to the pillar 150 installed inside the drum 30.

Looking in the direction of the pillar 150 from the spray device 80, the first nozzle 871 may spray water toward the drum 30 located on the left side of the pillar 150 and the second nozzle 873 may spray water toward the drum 30 located on the right side of the pillar 150. It is not simply limited to this, and the first nozzle 871 may spray water toward a right space of the pillar 150 and the second nozzle 873 may spray water toward a left space of the pillar 150. The spray direction in which each nozzle sprays water may be properly selected.

As described above, if the first nozzle 871 sprays water toward the left side of the pillar 150, the sprayed water may reach the drum floor surface 33 or an inner circumferential surface of the drum 30 and then scatter. The scattering water may reach the right side of the above pillar 150. However, 'spraying water in a specific direction' in this specification may mean a direction when the water passes through the spray orifice or a normal direction extended from the center of gravity of the spray orifice, and the location at which the sprayed water arrives may be understood separately from the spray direction.

In other words, based on the pillar 150, the first nozzle 871 and the second nozzle 873 may spray water into different spaces of the drum 30, thereby spraying water more evenly into the drum 30. If water is sprayed evenly into the drum 30, the washing and rinsing efficiency can be prevented from decreasing due to the water concentrated in a specific position.

Figure 6C:
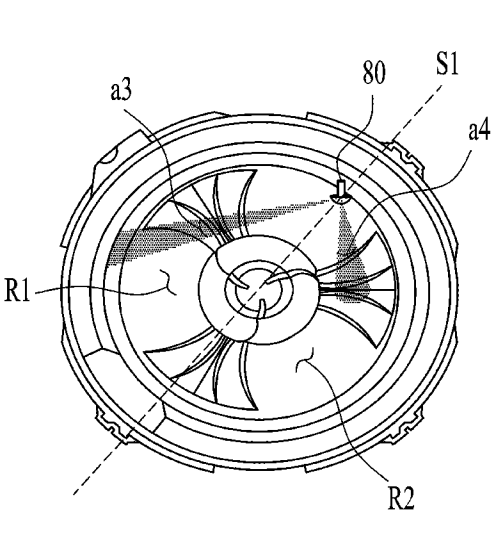
FIGS. 6A to 6C are diagrams of front, side and top views showing a state of spraying water to a drum from a spray device according to one embodiment of the present disclosure.
Figure 6B:
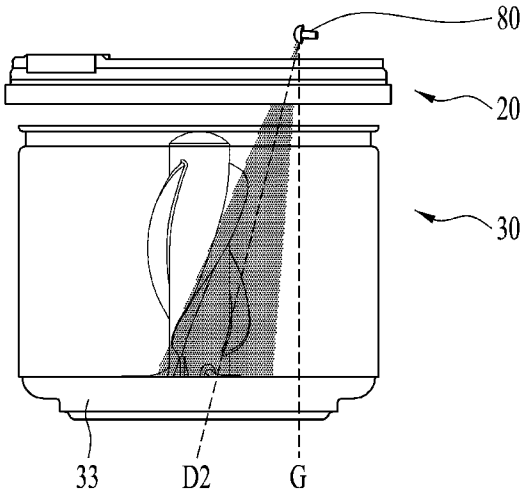
Figure 6A:
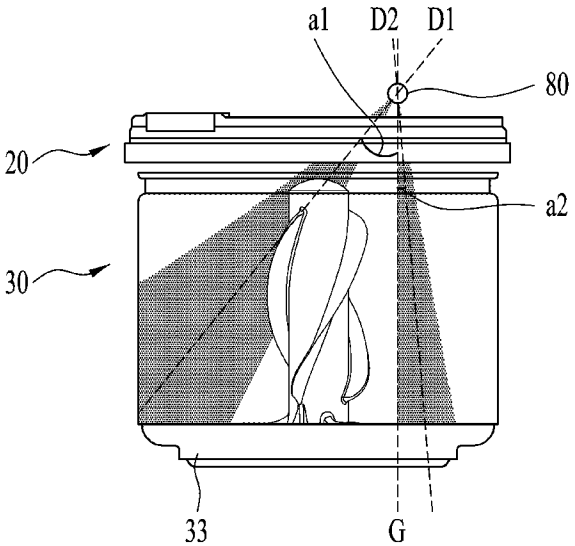

FIGS. 6A to 6C show a spray pattern of water sprayed from a spray device according to one embodiment of the present disclosure. FIGS. 6A to 6C are front, side and top view diagrams of the spray pattern, respectively.

Assuming a virtual plane 51 connecting the pillar 150 and the spray device 80 to each other with reference to FIG. 6C, an inner space of the drum 30 may be classified into a first drum space R1 and a second drum space R2 divided by the virtual plane 51. Thus, when the inside of the drum 30 is classified, the first nozzle 871 and the second nozzle 873 may spray water supplied through the nozzle supply pipe 81 toward the different spaces, respectively. As described above, the spray device 80 may spray water in various ways but prevent the water from being sprayed onto the pillar 150 and the blade 170. The spray direction of the water sprayed from the nozzle part 87 may be designed not to head for the pillar 150 or the blade 170, and the water having passed through the first spray orifice 872 and the second spray orifice 874 may be designed to reach the inside of the drum 30 without reaching the pillar 150 and the blade 170.

However, even in this case, the water sprayed from the injection device 80 may bounce on the inner circumferential surface of the drum 30 or the drum floor surface 33 and then reach the pillar 150 or the blade 170. In the present specification, "to spray water by avoiding the column 150 or the blade 170" may include all that the water primarily sprayed onto the components other than the column 150 and the blade 170 like the drum 30 is reflected and scattered to reach the column 150 or the blade 170.

Referring to FIG. 6A, the first nozzle 87), which configures the nozzle part 87 of the spray device 80 according to one embodiment of the present disclosure, may spray water supplied through the nozzle supply pipe 81 in the direction facing a circumferential surface of the drum 30. Furthermore, the second nozzle 873 may spray water supplied through the nozzle supply pipe 81 in the direction facing the drum floor surface 33.

As described above, spraying water in the direction facing the surface of the circumferential surface may mean a direction of extending a straight line vertical to the first spray orifice 872 from the center of the first spray orifice 872 formed at the end portion of the first nozzle 871. The direction toward the drum floor surface 33, which is the direction of water sprayed from the second nozzle 873, may also be understood in the same sense.

FIGS. 6A to 6C show the drum 30, the rotator 100, the top side of the tub 20 and the spray device 80 only except other components of the laundry treatment apparatus 1, and also show the spray pattern of the water sprayed from the spray device 80.

Referring to FIG. 6A, we examine the spray pattern of water sprayed from the first nozzle 871, which is formed on the left side of the spray device 80. A centerline of the spray pattern is illustrated as facing the inner circumferential surface of the drum 30. The centerline may mean the direction facing the inner circumferential surface of the drum. As confirmed in FIG. 6A, the water sprayed in the direction toward the inner circumferential surface of the drum arrives not only at the inner circumferential surface of the drum 30 limitedly but at the drum floor surface 33 or the bottom portion 110 of the rotator 100. However, depending on the above-described definition of the spray direction, the first nozzle may be understood to spray water supplied through the nozzle supply pipe 81 toward the inner circumferential surface of the drum 30.

Referring to FIG. 6C, according to the spray pattern of the water sprayed from the first nozzle 871 and the second nozzle 873, it can be confirmed that the water is sprayed into the drum by avoiding the pillar 150 and the blade 170.

In other words, the first nozzle 871 and the second nozzle 873 may spray water into the drum 30 and also spray water into the space except for the pillar 150 and the blade 170. The space inside the drum 30 is defined by the drum floor surface 33 and the inner circumferential surface of the drum 30, so the space except the pillar 150 and the blade 170 may be specified.

Referring again to FIG. 6A, it is confirmed that the water sprayed through the second nozzle 873 formed on the right side is sprayed toward the drum floor surface 33. The direction of extending the virtual line vertical to the center of the second spray orifice 874 formed at the end portion of the second nozzle 873 may be understood as a direction toward the drum floor surface 33. As can be found in FIG. 6A, the water is sprayed from the second nozzle 873 in the direction of the drum floor surface 33 and the pattern of the water may not be sprayed directly onto the inner circumferential surface of the drum 30. Furthermore, "spraying water in the direction facing the drum floor surface" can be understood as a concept including that water is initially sprayed from the second nozzle 873 toward the drum floor surface 33 and then sprayed into the inner circumferential surface of the drum 30 during a flow process of water.

As described above, if the first nozzle 871 and the second nozzle 873 configuring the nozzle part 87 are designed to spray water in a direction facing the inner circumferential surface of the drum 30 and a direction facing the drum floor surface 33, water can be supplied in a variety of directions to laundry received in the drum 30 in the course of using the laundry treatment apparatus. If water is sprayed in the direction of the inner circumferential surface of the drum 30, the water can directly reach the relatively high position of the drum 30. In addition, as water is sprayed on the inner circumferential surface of the drum 30, even if the drum 30 is filled with laundry over a predetermined height, the water can be effectively supplied to the drum floor surface 33 along the inner wall of the drum 30.

In case of the second nozzle 873, water is sprayed in two directions toward the drum floor surface 33, so if laundry is stored over a predetermined height in the drum 30, the sprayed water may not effectively reach the laundry stored adjacent to the drum floor surface 33. Therefore, if a large amount of laundry is stored as above, spraying water toward the inner circumferential surface of the drum 30 may be effective for washing and rinsing.

On the other hand, when a small amount of laundry is stored inside the drum 30 and located below a predetermined height, water may not be sprayed directly onto the stored laundry if water is sprayed onto the inner circumferential surface of the drum 30. The water sprayed onto the inner circumferential surface of the drum 30 primarily reaches the inner wall of the drum 30 and loses momentum, which can reduce the effect of rinsing compared to direct spraying water onto laundry. In the above case, the second nozzle 873, which sprays water directly toward the drum floor surface 33, can perform the washing and rinsing courses more effectively.

Namely, when the first nozzle 871 sprays water in the direction of the inner circumferential surface of the drum and the second nozzle 873 sprays water in the direction of the drum floor surface 33, washing and rinsing courses can be performed properly even if a large amount of laundry is stored in the drum 30 as well as a small amount of laundry is stored in the drum 30.

In some implementations, an area of the first spray orifice 872 formed at the end portion of the first nozzle 871 may be formed greater than that of the second spray orifice 874 formed at the end portion of the second nozzle 873. The water flowing by being branched from the nozzle branch part 85 may flow more through a side having a greater volume of a flow path of the first nozzle 871 or the second nozzle 873. Hence, it may be designed to enable more water to be sprayed from the first nozzle 871. According to the structural property of the spray device 80, lengths of the first and second nozzles 871 and 872 may be similar to each other. Therefore, an amount of the sprayed water can be adjusted using an area difference between the first and second spray orifices 872 and 874. To increase a flow amount of the first nozzle 871, an area of the first spray orifice 872 may be increased.

Furthermore, in case of designing the second nozzle 873 to spray more water, an area of the second spray orifice 874 may be formed greater than that of the first spray orifice 872.

In some implementations, a first angle a1 formed by a first spray direction D1, which is a direction of discharging the water from a center of the first spray orifice, and a reference direction, which is a direction of free fall of the water, may be formed greater than a second angle a2 that is an angle formed by a second spray direction D2, which is a direction of discharging the water from a center of the second spray orifice, and the reference direction. The reference direction G may be understood as a gravity direction.

As described above, the first spray direction D1 and the second spray direction D2 may be defined as directions of water passing through the first spray orifice 872 and the second spray orifice 874, respectively. If an angle formed with the reference direction meaning the gravity direction increases more, water can be sprayed onto a wider area. Namely, as the first angle a1 is designed greater than the second angle a2, the first nozzle 871 may spray water onto an area wider than the second nozzle 873. However, it is not limited to this, and if necessary, the second angle a2 may spray water more than the first angle a1. In other words, a specific nozzle may be designed to spray water onto a wider area than other nozzles instead of designing that a plurality of nozzles spray water equally. As such, the spray device 80 can improve washing and rinsing performance by spraying water in various patterns.

Referring to FIG. 6C, a spray pattern of water sprayed from the spray device is viewed from a top side. An angle formed by a pattern of water sprayed from the first nozzle 871 located on the left side may be defined as a first spray angle a3, and an angle formed by a pattern of water sprayed from the second nozzle 873 located on the right side may be defined as a second spray angle a4.

Depending on the first spray angle a3 and the second spray angle a4, the sprayed water may be sprayed in a manner of avoiding or reaching the pillar 150 and the blade 170.

The first spray angle a3 and the second spray angle a4 may be selected appropriately in a designing process. As the first spray angle a3 and the second spray angle a4 are increased more, water can be sprayed onto a wider area to enhance the washing and rinsing effects. Yet, if the first spray angle a3 and the second spray angle a4 are increased excessively, water is sprayed into a limited space only, thereby being sprayed to the pillar 150 and the blade 170 inevitably.

Therefore, the first spray angle a3 and the second spray angle a4 may be adjusted appropriately depending on locations of the first nozzle 871 and the second nozzle 873.

In addition, a first spray amount, which is the amount of water sprayed from the first spray orifice for a reference time, may be greater than a second spray amount that is the amount of water sprayed from the second spray orifice for the reference time. The first spray amount may mean the volume of water sprayed per second, and units of use may include $m^3/s$, $cm^3/s$, $mm^3/s$, etc. As described above, water is sprayed into the drum 30 in various patterns by setting different spray amounts of water sprayed from each nozzle, thereby improving washing and rinsing effects.

Figure 7:
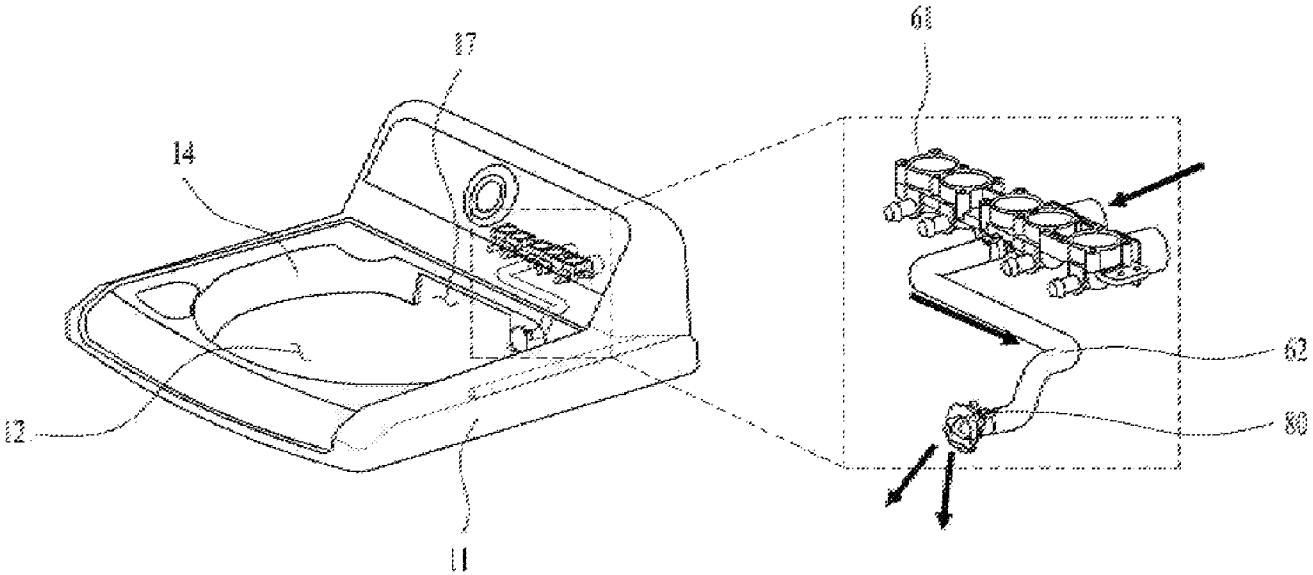
FIG. 7 is a diagram showing in detail that a spray device and a water supply part are connected to each other according to one embodiment of the present disclosure.

FIG. 7 shows a structure that a spray device according to one embodiment of the present disclosure is connected to the water supply part.

Referring to FIG. 7, a detergent supply device 15 provided to the cabinet top side 11 to store a detergent therein and supply the detergent to the drum 30 or the tub 20 is further included. The water supply part 60 is connected to the detergent supply device 15 and the spray device 80 and may supply water into the tub 20 through at least one of the detergent supply device 15 and the spray device 80.

The water supply part 60 may include an external water supply flow path (not shown) guiding water supplied by being connected to the water supply source to an inside of the cabinet 10, a water supply valve 61 connected to the external water supply flow path (not shown) to selectively open/close the external water supply flow path (not shown), an internal water supply flow path (not shown) connecting the water supply valve 61 and the detergent supply device 15 together to guide the supplied water to the detergent supply device 15, and a spray water supply flow path 62 connecting the water supply valve 61 and the spray device 80 together to guide the supplied water to the spray device.

The water supply valve 61 may receive cold water and hot water separately from the water supply source. One side of the water supply valve 61 may receive the cold water and supply the cold water to the detergent supply device 15. The other side may receive the hot water and supply the hot water to the detergent supply device 15. The water supply valve 61 may adjust the temperature of wash water by properly adjusting the inflow of the cold water and the hot water.

As shown in FIG. 7, the spray device 80 may be connected to a portion of the water supply valve 61, which receives cold water. When connected as above, the spray device 80 may spray cold water into the drum 30. However, it is not limited to this, and it will be possible to control the temperature of water sprayed from the spray device 80 by being supplied with the hot water.

In some implementations, the cabinet top side 11 may include the laundry opening face 14 forming an inner circumferential surface of the laundry opening 12, the spray device 80 may include the nozzle supply pipe 81 connected to the water supply part 60 by penetrating the laundry opening face 14 to be supplied with water from the water supply part 60 and the nozzle part 81 coupled to the nozzle supply pipe 81 to spray the water supplied through the nozzle supply pipe 81 into the drum, and the nozzle supply pipe 81 may be connected to the spray water supply flow path 62.

The spray water supply flow path 62 may be connected in a manner of enclosing an outer circumferential surface of the nozzle supply pipe 81. The spray water supply flow path 62 is coupled to the outer circumferential surface of the nozzle supply pipe 81 and a fastening member externally fastening the spray water supply flow path 62 more firmly is coupled thereto, thereby preventing water from leaking out of the spray water supply flow path 62.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry treating apparatus comprising:

a cabinet that defines an exterior of the laundry treating apparatus, the cabinet defining a laundry opening configured to receive laundry therethrough;

a tub located within the cabinet, the tub defining a tub opening that is in communication with the laundry opening;

a water supply part connected to a water supply source and configured to supply water to the tub;

a drum rotatably located in the tub, the drum defining a drum opening that is in communication with the tub opening and faces a drum floor surface located at an opposite side of the drum opening;

a rotator rotatably located within the drum, the rotator comprising:

a bottom portion located at the drum floor surface, a pillar that protrudes from the bottom portion toward the drum opening, and a blade located at an outer circumferential surface of the pillar; and a spray device connected to the water supply part and configured to spray the water supplied from the water supply part into the drum through the drum opening in a direction avoiding the pillar and the blade, wherein the spray device comprises:

a nozzle supply pipe connected to the water supply part and configured to receive the water from the water supply part, a nozzle branch part disposed at one end portion of the nozzle supply pipe, a first nozzle branched from the nozzle branch part and configured to spray the water supplied through the nozzle supply pipe in a first direction, and a second nozzle branched from the nozzle branch part and configured to spray the water supplied through the nozzle supply pipe in a second direction different from the first direction.

2. The laundry treating apparatus of claim 1, wherein the spray device is located outside the tub.

3. The laundry treating apparatus of claim 2, wherein the cabinet comprises a cabinet top side that defines a top surface thereof and the laundry opening, and wherein the spray device is located at the cabinet top side.

4. The laundry treating apparatus of claim 3, wherein the cabinet top side comprises a laundry opening face that defines an inner circumferential surface of the laundry opening, and wherein the spray device is located at the laundry opening face.

5. The laundry treating apparatus of claim 1, wherein the first nozzle is configured to spray the water to a first side with respect to the pillar, and wherein the second nozzle is configured to spray the water to a second side with respect to the pillar, the second side being different from the first side.

6. The laundry treating apparatus of claim 1, wherein the drum has a first drum space and a second drum space that are divided by a virtual plane connecting the spray device and the pillar, wherein the first nozzle is configured to spray the water toward the first drum space, and wherein the second nozzle is configured to spray the water toward the second drum space.

7. The laundry treating apparatus of claim 5, wherein the first nozzle is configured to spray the water toward a circumferential surface of the drum, and wherein the second nozzle is configured to spray the water toward the drum floor surface.

8. The laundry treating apparatus of claim 5, wherein the first nozzle defines a first spray orifice at an end portion thereof, the first spray orifice being configured to discharge the water in the first direction, wherein the second nozzle defines a second spray orifice at an end portion thereof, the second spray orifice being configured to discharge the water in the second direction, and wherein an area of the first spray orifice is greater than an area of the second spray orifice.

9. The laundry treating apparatus of claim 8, wherein the first direction corresponds to a first spray direction of water discharged through a center of the first spray orifice, the first spray direction defining a first angle with respect to a gravity direction, wherein the second direction corresponds to a second spray direction of water discharged through a center of the second spray orifice, the second spray direction defining a second angle with respect to the gravity direction, and wherein the first angle is greater than the second direction.

10. The laundry treating apparatus of claim 8, wherein the first nozzle is configured to discharge a first spray amount of water through the first spray orifice for a reference time, wherein the second nozzle is configured to discharge a second spray amount of water through the second spray orifice for the reference time, and wherein the first spray amount of water is greater than the second spray amount of water.

11. The laundry treating apparatus of claim 3, further comprising a detergent supply device located at the cabinet top side and configured to store a detergent therein, the detergent supply device configured to supply the detergent to the drum or the tub, and wherein the water supply part is connected to the detergent supply device and the spray device and configured to supply the water into the tub through at least one of the detergent supply device or the spray device.

12. The laundry treating apparatus of claim 11, wherein the water supply part comprises:

an external water supply flow path connected to the water supply source and configured to guide the water to an inside of the cabinet;

a water supply valve connected to the external water supply flow path and configured to selectively open and close the external water supply flow path;

an internal water supply flow path that connects the water supply valve to the detergent supply device and is configured to guide the water to the detergent supply device; and a spray water supply flow path that connects the water supply valve to the spray device and is configured to guide the water to the spray device.

13. The laundry treating apparatus of claim 12, wherein the cabinet top side comprises a laundry opening face that defines an inner circumferential surface of the laundry opening, and wherein the nozzle supply pipe is connected to the water supply part and penetrates the laundry opening face, the nozzle supply pipe being configured to receive the water through the spray water supply flow path.

14. The laundry treating apparatus of claim 13, wherein the laundry opening face defines a detergent supply opening that accommodates the detergent supply device and is in communication with the laundry opening, and wherein the spray device is located at one side of the detergent supply opening.

15. The laundry treating apparatus of claim 14, wherein the spray device and the detergent supply opening are located rearward relative to the pillar.

16. The laundry treating apparatus of claim 1, wherein the spray device is located vertically above the drum opening and rearward relative to the pillar.

17. The laundry treating apparatus of claim 1, wherein the spray device comprises a plurality of orifices configured to spray the water in a plurality of directions avoiding the pillar and the blade.

18. The laundry treating apparatus of claim 17, wherein the plurality of orifices are configured to discharge the water in opposite directions with respect to the pillar.

19. The laundry treating apparatus of claim 1, wherein the spray device is disposed at a rear-left side or a rear-right side of the pillar, wherein the first nozzle defines a first orifice at an end of the first nozzle, the first orifice being configured to spray the water in one of a left side or a right side of the pillar, and wherein the second nozzle defines a second orifice at an end of the second nozzle, the second orifice being configured to spray the water in the other of the left side or the right side of the pillar.

* * * * *